US005377998A

United States Patent [19]

Schainbaum

[11] Patent Number: 5,377,998

[45] Date of Patent: Jan. 3, 1995

[54] MACHINE TO TRACK GAME EFFECTS

[76] Inventor: Joshua Schainbaum, 102 E. Pine St., Wenonah, N.J. 08090

[21] Appl. No.: 107,194

[22] Filed: Aug. 17, 1993

[51] Int. Cl.[6] ..... A63F 9/00

[52] U.S. Cl. ..... 273/459; 273/DIG. 26; 434/203

[58] Field of Search ..... 273/459, 466, DIG. 26; 235/68, 91 B; 434/203, 204

[56] References Cited

U.S. PATENT DOCUMENTS

| | | | |
|---|---|---|---|
| 352,218 | 11/1886 | Bolton et al. | 434/203 |
| 532,282 | 1/1895 | Myers | 434/203 |
| 637,964 | 11/1899 | Johnsen | 434/203 |
| 3,860,238 | 1/1975 | Kojima | 273/DIG. 26 X |
| 4,877,247 | 10/1989 | Francis | 273/DIG. 26 X |
| 4,993,952 | 2/1991 | Yeh | 434/203 X |

*Primary Examiner*—William H. Grieb

*Attorney, Agent, or Firm*—Beveridge, DeGrandi, Weilacher & Young

[57] ABSTRACT

A device is disclosed for enabling tracking of the duration and type of effect in fantasy board games of various types. The device also keeps track of any character affected by the events taking place in fantasy board games. The device is formed of two or more towers, each resting vertically on a base, that can be weighted for stability. Each tower has one removable flag in the top. For example, one flag can be green, signifying "active", and the other, red, signifying "inactive". Any two towers are connected to each other by a plurality of horizontal crossbars, for example, sixteen such crossbars. Each of these crossbars supports a plurality of mobile beads, for example, thirty. One crossbar is in the lower most position and supports a plurality of mobile disks, for example 60.

17 Claims, 4 Drawing Sheets

MACHINE TO TRACK GAME EFFECTS

INTRODUCTION AND BACKGROUND

The present invention relates to a machine to track game effects for use with fantasy board games, especially fantasy role playing games (FRPG). In such play, game variables which can be loosely termed "magic", "special abilities", "items", and the like, drastically affect outcomes during play, such as combat and negotiations, which are part of the games. Furthermore, variables such as fatigue, injury, hunger, or other temporary handicaps can hamper the abilities of the game pieces (known in FRPG terms as "characters"). The device of the invention keeps a running record of effects that influence characters during game play.

In fantasy board games, game time is kept at a different pace than real world time. For instance, a ten-minute hourglass would keep ten accurate real world minutes, but not game minutes. Ten minutes of game time is called a "turn", which could take less than or more than ten minutes of real world time. For FRPG playing purposes, each turn is divided into ten rounds, each signifying one minute of game time. Each round is divided into twenty-four segments, which helps determine who acts first in each round. When all characters who are able to do so have acted once, a round is considered completed (one minute of game time has passed). This is true if there are two characters or twenty. Thus, game time passes at a different rate than real time.

It would be desirable to keep track of the duration and type of effect, and the character affected throughout the playing time. Game effects have non-standard durations in game time. It is quite common for two characters to be able to cast the same "magic spell", but the duration of the spell's effect depends on the relative magic power of each caster. It could last segments, it could last rounds, or the effect could last turns. Furthermore, it is not at all unusual for one character to be influenced by multiple effects at any given time. In addition, there may be multiple characters imposing various and multiple effects on themselves, their cronies, and their enemies at any given time.

SUMMARY OF THE INVENTION

It is an object of the present invention to provide a device enabling tracking of the duration and type of effect in fantasy board games of various types. It is a further object of the present invention to provide a device for keeping track of any character affected by the events taking place in fantasy board games.

In achieving the above and other objects, one feature of the present invention resides in a machine to track game effects that fits on any table top or flat, level surface, such as a floor. The device is formed of two or more towers, each resting vertically on a base, that can be weighted for stability. The base can be formed integrally with the tower. Each tower has one removable flag in the top. For example, one flag can be green, signifying "active", and the other, red, signifying "inactive". Any two towers are connected to each other by a plurality of horizontal crossbars for example sixteen such crossbars. Each of these crossbars supports a plurality of mobile beads, for example, thirty. One crossbar is in the lower most position and a plurality of supports mobile disks, for example 60.

BRIEF DESCRIPTION OF THE DRAWINGS

The present invention will be further understood with reference to the drawings, wherein.

DETAILED DESCRIPTION OF THE INVENTION

Figure 1:
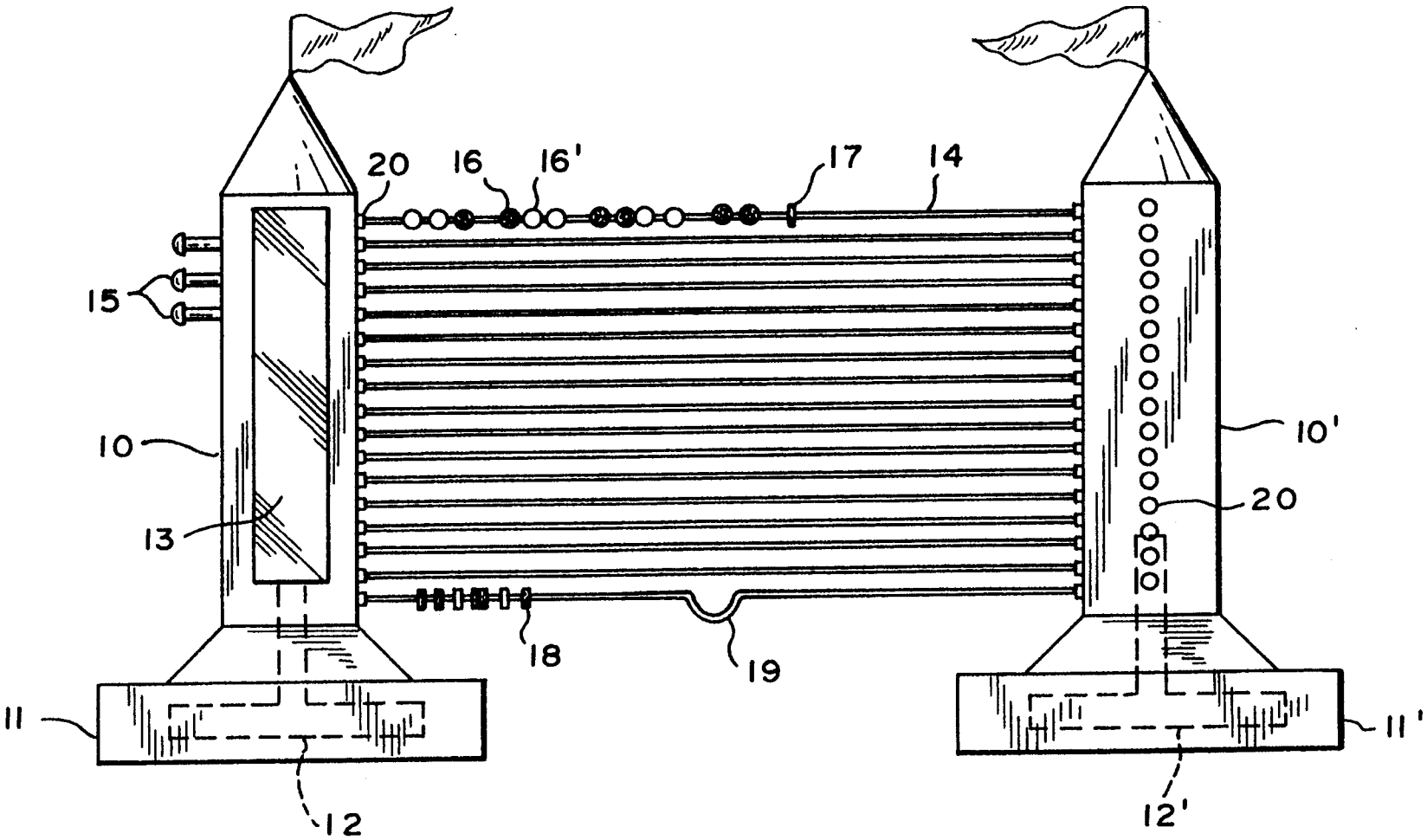
FIG. 1 is a schematic elevation view of the device of the present invention.

FIG. 1 shows an elevational view of the towers 10 and 10'. Each tower is attached to a base 11 and 11' which can be weighted with weights 12 and 12' to add stability to the device.

Towers and their bases can be made of any sturdy material such as plastic, metal, wood, marble, or a combination of these.

Each tower can be fitted with a recessed dry-erase message board 13 requiring ninety (90) degrees horizontally, and substantially the entire vertical plane of the tower from the top to the base of the tower. Although the dry-erase message board requires ninety of three hundred and sixty degrees (90/360), it remains a flat writing surface because it is recessed. An alternate method is to let the dry-erase board being flush with the top of the tower, and descend at a constant angle of a 3:1 ratio until it meets the base, forming the third side of a right triangle. The base 12 of each tower 10 has a clip (not shown) that can hold a dry-erase marker (not shown). Each tower has three (3) sets of seventeen (17) holes, one quarter of an inch ($\frac{1}{4}''$) deep, which are cut on three (3) separate vertical planes (for a total of 51 holes). Each vertical plane is separated by ninety (90) degrees. Each hole within a set of seventeen along a vertical plane is separated from the next hole by three quarters of an inch ($\frac{3}{4}''$). Expressed another way, each tower has seventeen (17) sets of three (3) holes, with each set of three holes cut on a different horizontal plane. Each horizontal plane is separated by three quarters of an inch ($\frac{3}{4}''$). Each hole in a set of three holes on the same horizontal plane is separated from the next hole by ninety (90) degrees. The holes require two hundred and seventy of three hundred and sixty degrees (270/360). Each of the fifty-one (51) holes are exactly perpendicular to the vertical plane of each tower.

$$270 \text{ degrees tower circumference [holes]} + \frac{90 \text{ degrees tower circumference [dry-erase message board]}}{360 \text{ degrees} - \text{tower circumference}}$$

On any one tower, two vertical sets of seventeen holes are used to be used for holding crossbars 14, and one vertical set of seventeen holes is to be used for holding removable colored pegs (15). If only two towers are used, one vertical set of seventeen holes on each tower will not be in use. However, if a third tower is in use, seventeen more crossbars would be added to either side—for a total of thirty-four (34) crossbars, thus doubling the tracking capacity of the device of the invention.

Figure 2:
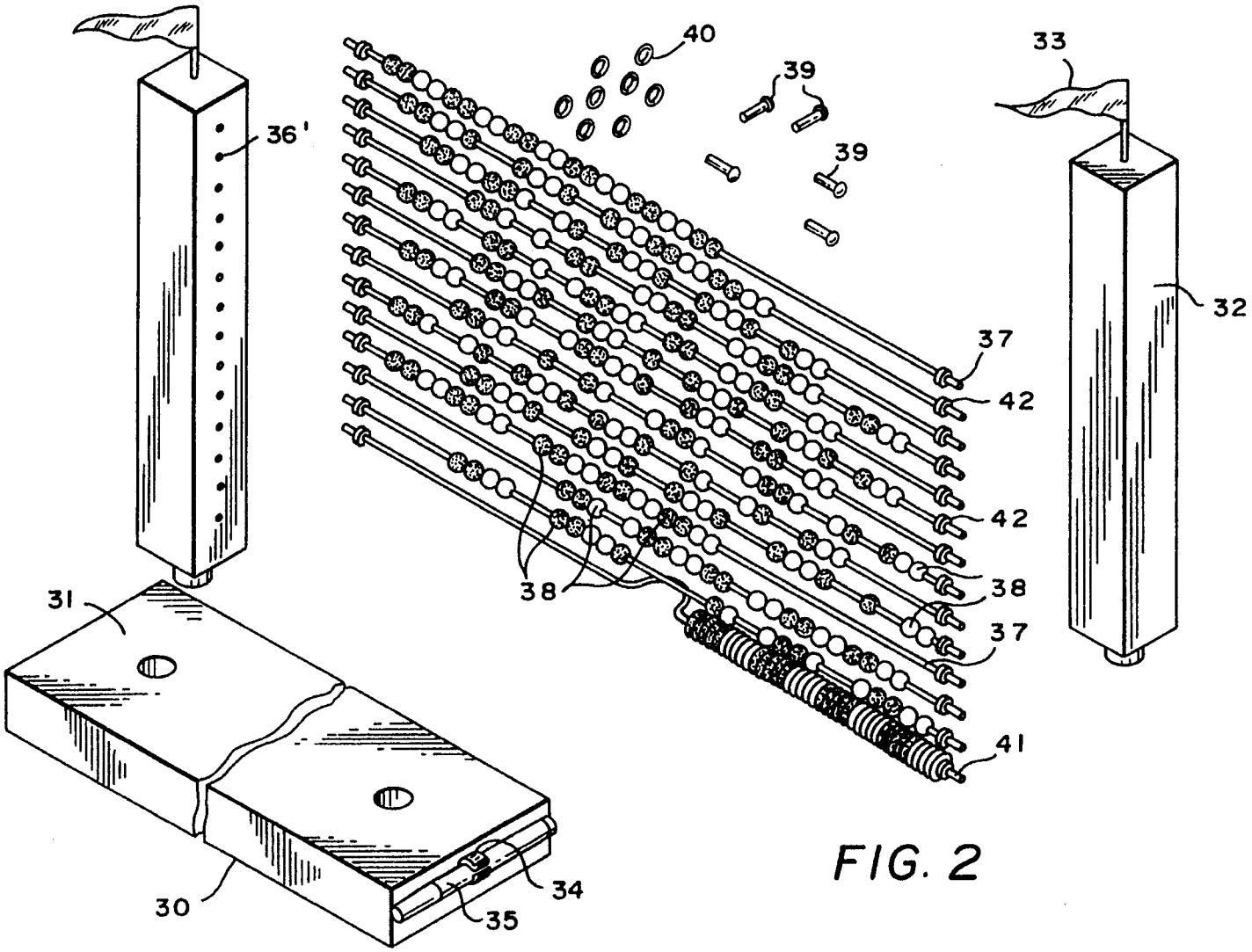
FIG. 2 is an exploded plan view showing the components of the device of the present invention.

FIG. 2 shows one base member 30 fitted with receiving holes 31 for receiving the mating end of tower 32.

Each tower has a differently colored flag 33. Base 30 has a clip 34 for holding a marker 35. Each tower has a plurality of holes on oppositely facing surfaces 36 and 36' into which holes are fitted a corresponding plurality of crossbars 37. The crossbars hold a plurality of differently colored beads 38. Differently colored pegs 39 fit into holes (not shown) on the tower on the side opposite from the holes for holding crossbars 37. Rings 40 can be fitted over the crossbars. Disks are located on the lower most crossbar referred to as the hair pin 41. Stopper 42 prevent the crossbars from sliding out of their respective holes.

Figure 3:
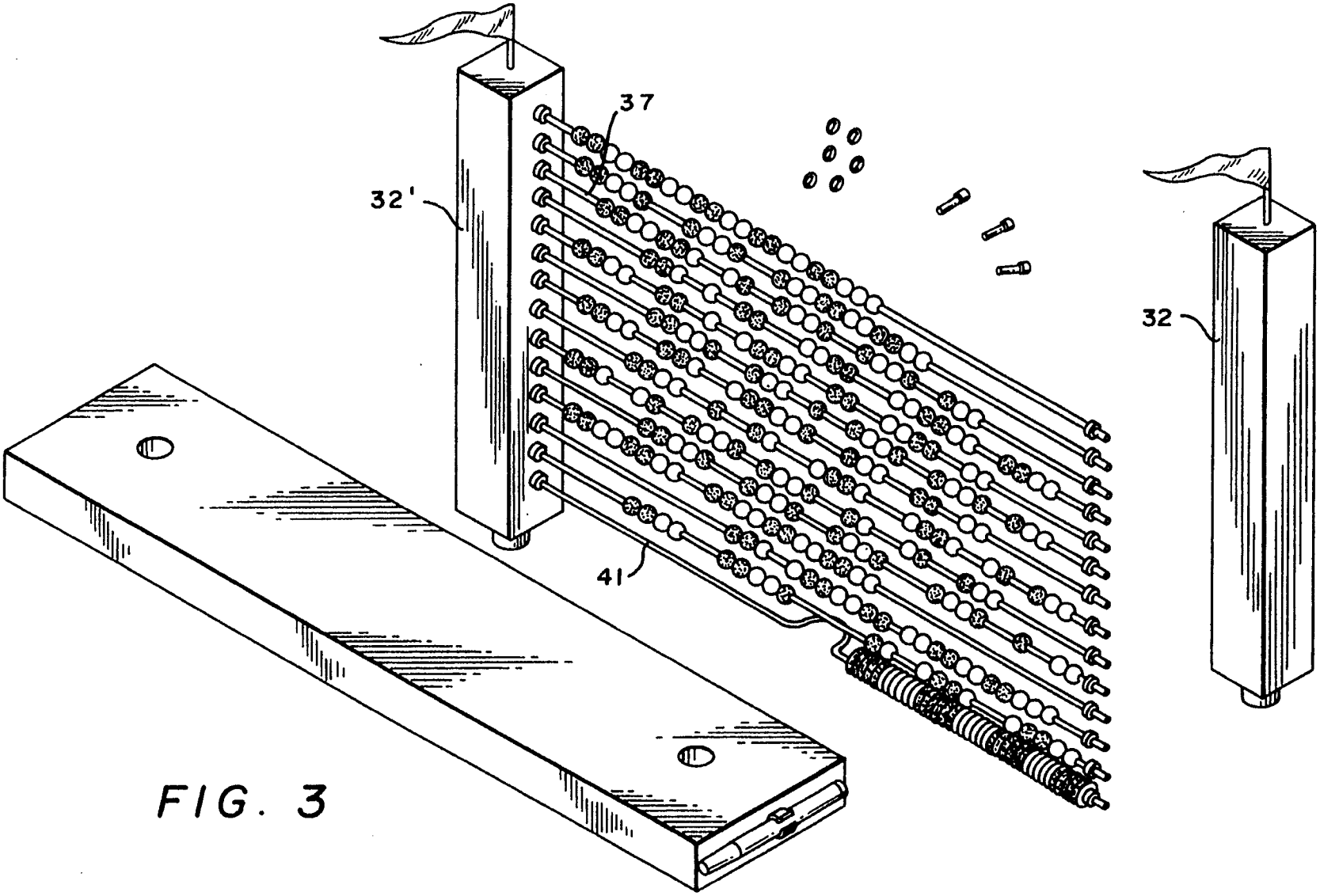
FIG. 3 is a plan view of the partially assembled device of the invention.

FIG. 3 shows a partial assembly of the device of the present invention and illustrates the crossbars 37 inserted into one of the towers 32'. Hair pin crossbar 41 is also shown inserted at one end into the tower 32'.

Figure 4:
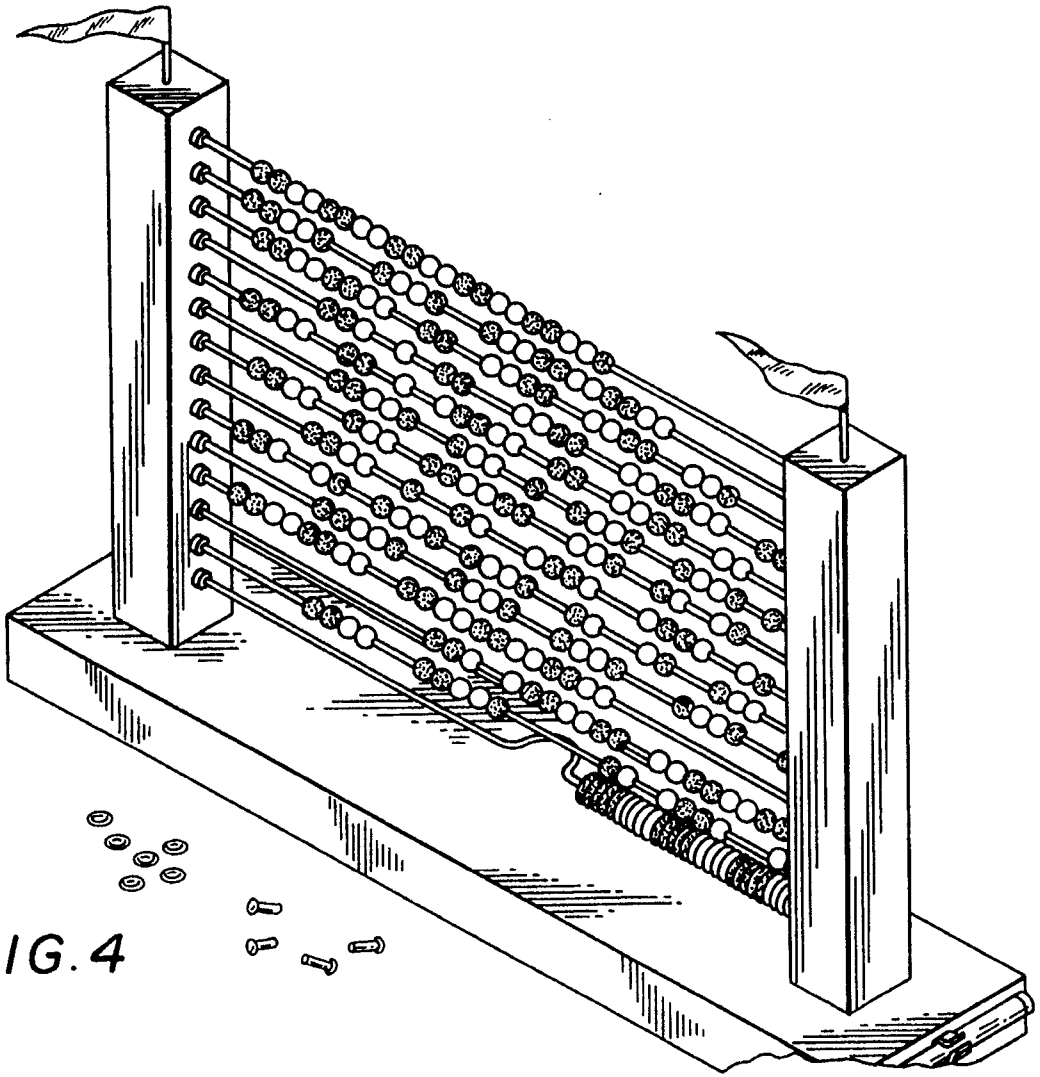
FIG. 4 is an elevational view of the assembled device of the invention.

FIG. 4 illustrates the fully assembled device of the invention.

As shown in FIG. 1, any two towers 10, 10' are connected by sixteen horizontal, perfectly straight, cylindrical crossbars 14 of brass, aluminum, wood, or steel, and one crossbar of brass, aluminum, or steel, which is straight from each tower until approximately one inch (1") from the mid-point, at which point the crossbar is bent in a "hair pin 19". A wooden crossbar would have an enlarged width at the midpoint to achieve the same results as the hair pin bend in a metal crossbar. All crossbars are level and parallel to one another, and perpendicular to each of the two towers. Viewed from above, all are on the same vertical plane. All seventeen crossbars are evenly spaced from each other, for example, they rest three quarters of an inch (¾") apart. Specific dimensions can, of course, be varied. The seventeen crossbars (referred to by number from the top down) connect to the towers through the means of a simple peg-in-hole method.

Each of the sixteen straight crossbars 14 threads the center of thirty (30) wooden, plastic, rubber, marble, ceramic or metal beads 16, 16', between two stationary wooden, plastic rubber, marble, ceramic, or metal plugs or stoppers 20. The plugs are placed a suitable distance, say one quarter of an inch (¼"), from each end, so that beads slide along the crossbar between, but not past, the two plugs, and each plug is flush against the side of a tower.

The beads alternate in pairs between a dark color and a light color.

Each bead can signify a given period of game time; segments, rounds, turns, etc.

Hair pin crossbar 17 has sixty disks 18 of wood, plastic, rubber, marble, ceramic, or metal which also slide between, but not past, two end-plugs which are flush against the side of each tower. The disks alternate in groups of five between a dark color and a light color. The "hair pin" bend in the middle of crossbar (or increased thickness of a wooden crossbar) is designed to slightly impede the movement of each disk along the crossbar, and to serve as a marker.

Each disk signifies a given period of game time-segments, rounds, turns, etc.

For any two towers, sixteen rubber washers 40 (shown in FIG. 2) serve as markers, one for each of the straight, beaded crossbars. The washers are slit (interrupting the continuity of the material) so that they may be removed or placed anywhere on a crossbar without removing the crossbar itself from the towers, but will not fall off of the crossbar on their own. The washers separate "active" from "inactive" beads; that is, beads which should be counted to track game effects, and those which do not enter the count, respectively.

For any two towers, sixteen wooden pegs 39, each a different color, signify which character or game entity is under the influence of a game effect. Each peg is removable, and fits in one of the holes either ninety (90) or one hundred and eighty (180) horizontal degrees from the crossbar on which the game effect is designated for tracking.

While the foregoing description has disclosed separate bases for the tower, the towers can also be designed with a suitable lower portion which performs the function of a base. Thus, for example a tower having integrally formed therein a base can be in the shape of a broad bottom sufficiently stable to support the tower in place. A tower shaped like a pyramid, cone, large diameter cylinder are examples of suitable structures which eliminate the need for a separate base.

There will now be described the manner in which the machine to track game effects can be used by a game player.

When a game effect becomes a factor affecting outcomes during play, the Game Master (GM), or, referee, is informed of or determines which characters are affected. An individual colored peg, signifying each affected character, is placed in one of the holes on a tower on the same horizontal plane as the crossbar which will track the duration of the effect.

Next, the GM writes the name of the effect on the dry-erase board at a point that is on the same horizontal plane as the colored wooden peg and the crossbar which will track the duration of the effect.

Third, the GM is informed of or determines the duration of the effect in game time, and places on of the rubber washers at a point on the crossbar which will segregate that number of "active" beads from the remaining, "inactive" beads, if any. Finally, as each unit of game time passes as represented by one bead on each crossbar, the GM slides that bead from the "active" tower's side (identified by the green flag on top) to the "inactive" tower (signified by the red flag on top). The rubber washer will move with the first bead to touch the "inactive" beads or tower, and remains as a marker in case of dispute. After each unit of game time passes, the GM also slides one disk on the crossbar hair pin to the "inactive" side of the "hair pin" bend (or increased thickness if the cross bar is wooden). This serves as a fail-safe counter. If the device of the invention is inadvertently (or intentionally) toppled, the disks would serve as an adequate check of how many units of a game time have passed, because the "hair pin" bend prevents the free movement of disks from one side of the crossbar to the other. Thus, "active" and "inactive" beads can be reset by counting the number of game units passed (number of disks on hair pin crossbar), counting backwards from the rubber washer on each crossbar (which serves as a marker for the original duration of the effect). What remains on the "active" side of each washer after counting back, is the current number of active game units for any given effect.

The device of the invention can be sold partially or fully assembled, or as a kit, to be assembled by the purchaser, Further modifications and variations of the invention will be apparent to those skilled in the art from the foregoing and are intended to be encompassed by the claims appended hereto.

I claim:

1. A device for tracking a fantasy roll playing board game, comprising:

a plurality of towers adapted to support a plurality of straight crossbars therebetween, a plurality of beads slidingly arranged on said crossbars, said beads being of at least two different colors and being arranged in pairs on said crossbars, said plurality of crossbars including a crossbar having a plurality of disks of at least two colors, said disks being arranged in groups of five, said beads being used to track duration of game effects on individual game entities, and said disks being used to track overall game duration.

2. The device of claim 1 wherein said towers are adapted to fit onto a base so that each tower is positioned on a base permitting the tower to stand upright.

3. The device according to claim 2 wherein said base is weighted for stability.

4. The device of claim 1 wherein sixteen crossbars are utilized to support said beads and a seventeenth crossbar is provided as a lower crossbar to support said disks, said seventeenth crossbar having a central portion in the shape of a bent section to prevent said disks from freely sliding past said central portion.

5. The device of claim 1 wherein each of said crossbars has at each end thereof a stopper plug to prevent the crossbar from sliding.

6. The device of claim 1 wherein each tower has on one surface thereof a plurality of holes adapted to accept colored pegs, said holes for the pegs each corresponding to a crossbar wherein a peg is placed in a hole to signify that beads on said corresponding crossbar are used to track game effects on a game entity represented by said peg.

7. The device of claim 1 wherein at least one of said towers is fitted with a writing surface for marking the game effect represented by a row of beads corresponding to such a marking.

8. The device of claim 1 wherein each tower has a quadrilateral cross section.

9. The device of claim 1 wherein one tower is fitted with a red flag indicating inactive status, and one tower is fitted with a green flag indicating active status.

10. The device according to claim 9 wherein a plurality of rubber washers are provided which are adapted to fit into a crossbar to separate active beads from inactive beads.

11. The device according to claim 1 wherein each crossbar has a pair of light colored beads and at least one pair of dark colored beads mounted slidably on said crossbar.

12. The device according to claim 1 wherein a plurality of colored pegs are provided to fit into holes on at least one surface of the tower.

13. A kit for assembling a device for tracking a fantasy board game, comprising:

a plurality of towers provided with a plurality of holes adapted to hold a plurality of straight crossbars therebetween, each of said crossbars having two ends, one end being adapted to fit into one tower and an opposite end of the crossbar being adapted to fit into another tower, a plurality of beads, said beads being of at least two different colors and having a hole therethrough so as to slidably fit on said crossbars, and one crossbar having a plurality of disks of at least two colors arranged in groups of five on said one crossbar, wherein a mid portion of said one crossbar prevents said disks from freely sliding past said mid portion, said beads being used to track duration of game effects on individual game entities, and said disks being used to track overall game duration.

14. The kit of claim 13 which additionally includes a base adapted for supporting said towers.

15. The kit of claim 13 which additionally contains a plurality of stopper plugs adapted to fit onto said crossbars.

16. The kit of claim 13 wherein a thickened section is used at said mid portion of said one crossbar to prevents said disks from freely sliding past said mid portion.

17. The kit of claim 13 wherein a bent portion is used at said mid portion of said one crossbar to prevent said disks from freely sliding past said mid portion.

* * * * *